United States Patent [19]

Frank

[11] 4,125,902

[45] Nov. 21, 1978

[54] FITS ALL SIZES WRAP-AROUND GARMENT

[75] Inventor: Michael B. Frank, Chicago, Ill.

[73] Assignee: Uniforms To You & Co., Chicago, Ill.

[21] Appl. No.: 824,860

[22] Filed: Aug. 15, 1977

[51] Int. Cl.[2] ..... A41D 1/22

[52] U.S. Cl. ..... 2/74

[58] Field of Search ..... 2/105, 74, 48, 243 B, 2/52, 73, 49 R, 75, 76, 221; D2/226

[56] References Cited

U.S. PATENT DOCUMENTS

| | | | |
|---|---|---|---|
| 2,462,553 | 2/1949 | Reno | 2/76 |
| 2,666,920 | 1/1954 | Lang | 2/75 |

*Primary Examiner*—Doris L. Troutman

*Attorney, Agent, or Firm*—Lockwood, Dewey, Alex & Cummings

[57] ABSTRACT

A wrap-around jumper dress capable of neatly fitting a variety of shapes and sizes of female figures. The garment is formed of a separate bib and a separate wrap-around skirt. The lower edge of the bib is concave and joined to the concave edge of the front central portion of the skirt. A sash is attached to the opposite upper corners of the skirt and a sash-receiving opening is formed in one of the upper corners of the front central portion of the skirt. Preferably, the skirt is formed in three sections, a front central section and right and left hand sections. The invention is deemed an improvement over the garments shown in patents Nos. 1,209,018; 1,497,232; 2,136,983 and 2,507,602.

5 Claims, 6 Drawing Figures

FITS ALL SIZES WRAP-AROUND GARMENT

This invention relates generally to a garment of the wrap-around jumper type and to innovations and improvements which permit a garment of this type to neatly fit a variety of female figures ranging rather widely in respect to size and shape, particularly in height, waist and hip measurements.

It is customary for restaurants to provide their waitresses with matching uniforms. There is a similar practice with respect to airline stewardesses, female bank employees, etc. It would be desirable for the proprietors or operators of such businesses and others to minimize the inventory of uniforms required in order to provide such personnel with neatly fitting garments or uniforms. Furthermore, it would be desirable for dress manufacturers and firms in the wholesale and retail garment business to be able to offer a garment that will neatly fit a range of sizes and shapes of customers so as to minimize the stock of inventory of that garment which has to be maintained.

It has been found, in accordance with the present invention, that dresses or garments of the wrap-around jumper type may be provided which are capable of neatly fitting a variety of female figures having a substantial range or variation in respect to waist, hip and height dimensions and it is a general object of the present invention to provide such garments.

The objective of the present invention may be achieved by providing a wrap-around jumper dress or garment made from a separate skirt and a separate bib with the lower edge of the bib being concave as cut out and joined to the front central portion or section of the skirt which is also concave as cut out. Preferably, the skirt is formed in three sections or portions, the front central portion to which the bib is joined and left and right-hand portions or sections.

In order to obtain the proper and optimum fit of a wrap-around jumper of the present invention to various figures, sashes or ties are attached to the opposite upper corners of the skirt, and a sash or tie-receiving opening is provided adjacent one of the upper corners of the front central skirt section or portion. By drawing the sash or tie that is more remote from the opening through the opening and drawing the same up to the desired tightness, the garment will be properly positioned on the wearer for optimum fit and neat appearance.

For a more complete understanding of the nature and scope of the invention, reference may now be had to the following detailed description of a preferred embodiment thereof taken in connection with the accompanying drawings wherein.

Figure 1:
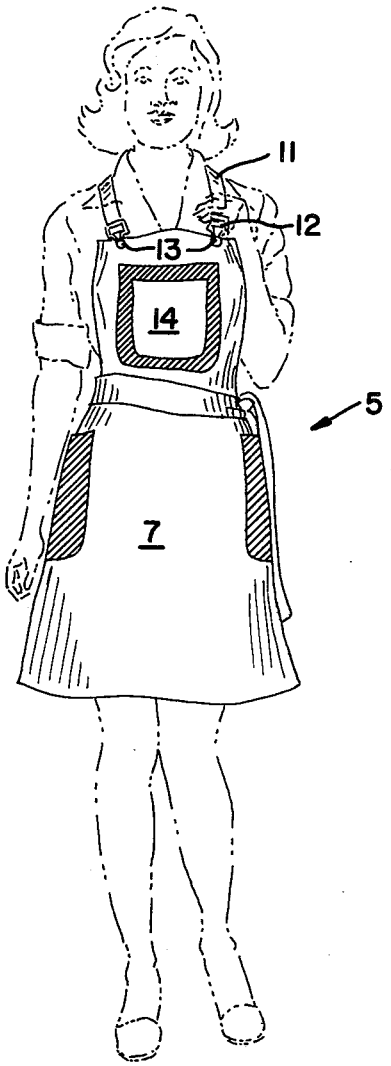
FIG. 1 is a front view of a female figure shown in broken line wearing a wrap-around jumper dress made in accordance with the present invention.
Figure 4:
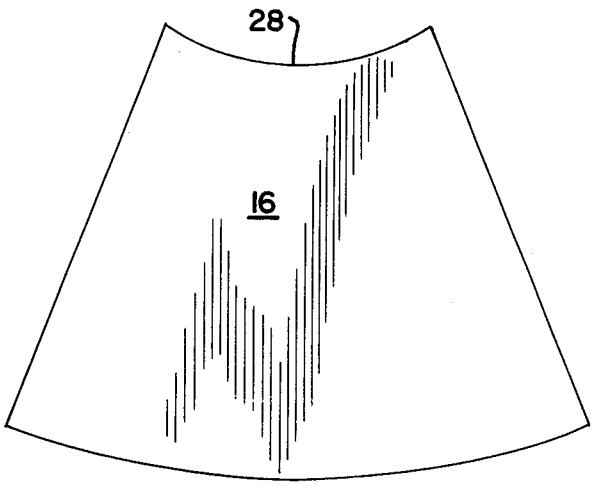
FIG. 4 is a view of the front central portion of the skirt as cut out and prior to being joined to the other portions of the garment.
Figure 2:
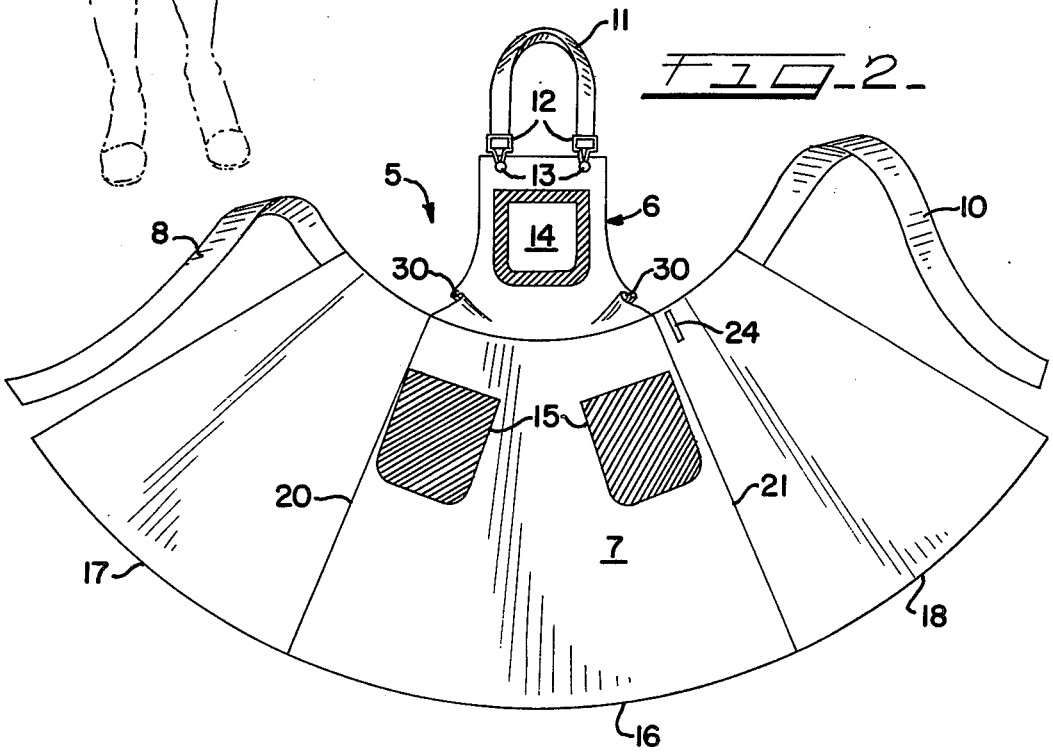
FIG. 2 is a front view of the garment of FIG. 1 laid out in an open flat condition.
Figure 5:
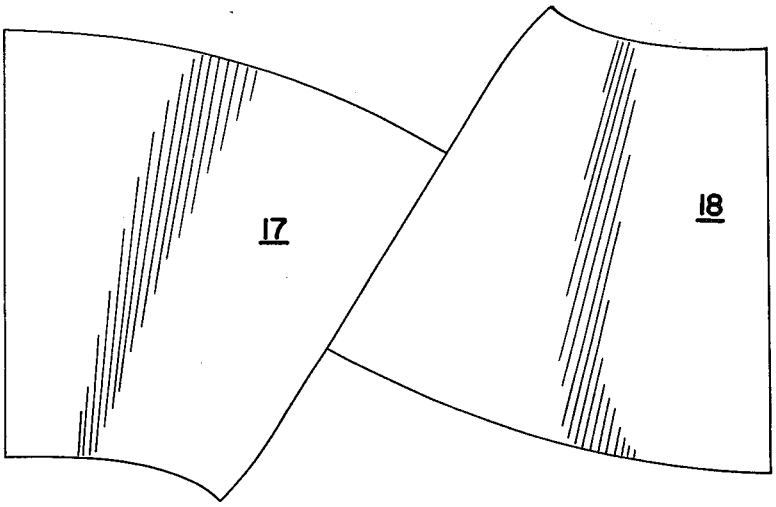
FIG. 5 is a view of the left and right-hand skirt sections or portions as cut out and prior to being joined in the garment.
Figure 3:
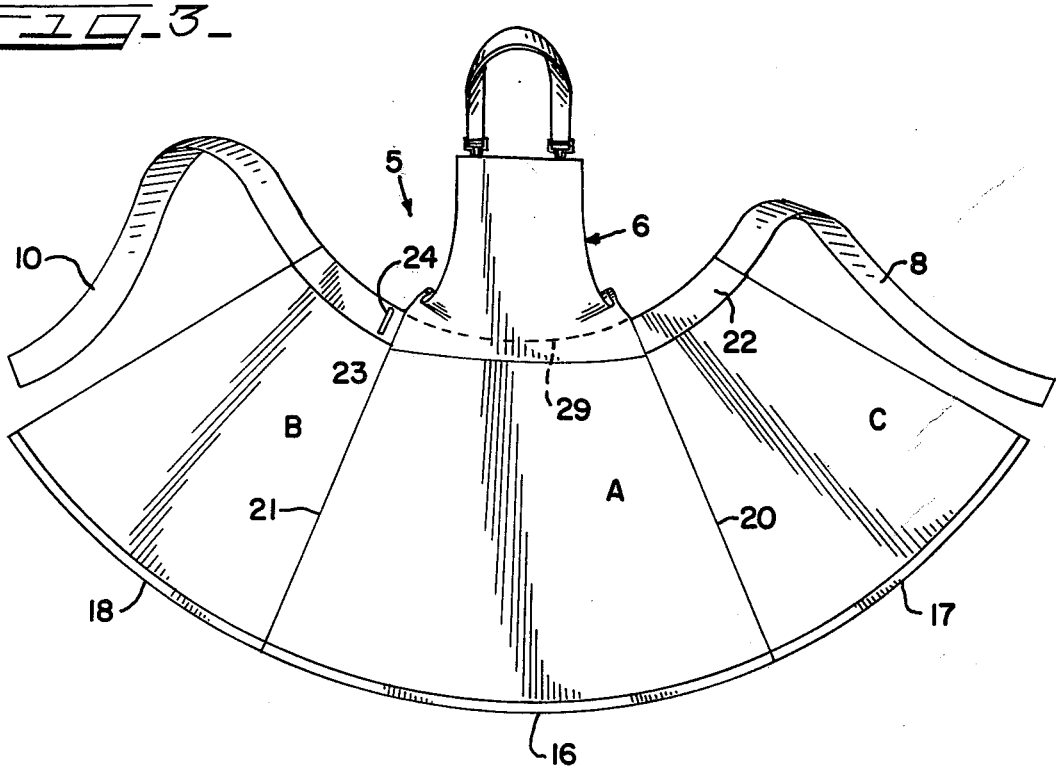
FIG. 3 is a view similar to FIG. 2 but of the inner or back side of the garment.

Referring to FIGS. 1, 2, and 3, it will be seen that the wrap-around jumper garment indicated therein generally at 5 has a bib 6 and a skirt indicated generally at 7. Sashes or ties 8 and 10 are attached to opposite upper corners of the skirt and an adjustable neck strap 11 is provided having conventional wire buckles 12–12 adjustably receiving the opposite ends of the neck strap and having clip portions for receiving or hooking over buttons 13–13 attached adjacent the upper edge of the bib 6. A double pocket 14 may be attached to the bib 6 while single pockets 15–15 are attached to the skirt 7.

The skirt 7 is formed in three portions or sections: a front central portion or section 16; a right-hand section 17; and a left-hand section 18. The left and right-hand sections 17 and 18 can be identical as cut out. The left and right-hand sections 17 and 18 are seamed or otherwise joined to the opposite edges of the front central section 16 along seams indicated at 20 and 21. Preferably the upper edges of the left and right-hand sections 17 and 18 are provided on the back side with narrow arcuate pieces 22 and 23 so as to provide a belt-like double thickness of the garment at these areas. The sashes or ties 8 and 10 as well as the neck strap 11 are also desirably formed in double thicknesses by folding over the material from which they are cut. A slot-like opening 24 is formed in the skirt 7 adjacent one of the upper corners of the front central portion or section 16 for receiving the sash 8 which is more remote than sash 10.

Figure 6:
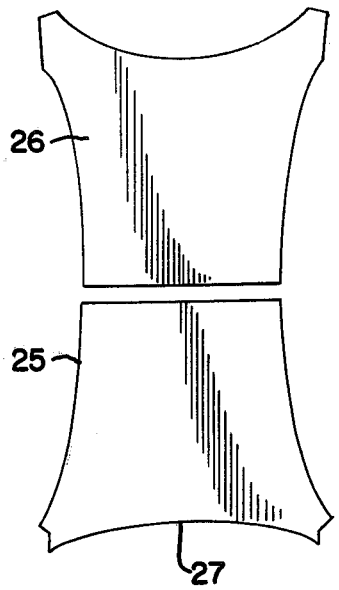
FIG. 6 is a view showing the front and back sides of the double thickness bib of the garment of FIG. 1 as cut out and prior to being joined together and to the skirt of the garment.

In the garment 5, the bib 6 is formed with a front 25 and a back 26. These can be cut from a piece of material as indicated in FIG. 6 so that the upper edges of these pieces have the same matching dimension. However, the back piece 26 is somewhat longer than the front 25 in order to provide a double thickness at the front central portion of the skirt which overhangs and shields the seam 29 joining the concave edges of the bib front 25 and the front central skirt portion 16.

It is important to note that, as cut out and prior to joining, the front section 25 of the bib has a concave lower edge 27 as also does the skirt section 16 have a concave edge 28. In fabricating the garment 5 the concave edges 27 and 28 are seamed or otherwise joined together at 29 thereby creating a bellows effect which take the form of puckers as indicated at 30—30 in FIGS. 2 and 3. It has been found that this bellows effect at the front central portion of the garment 5 allows it to neatly wrap around and fit a rather wide variation of waist and hip line dimensions.

The adjustable neck strap 11 permits the garment to be adjusted to wearers of different height and upper torso dimensions.

The sashes 8 and 10 together with the slot 24 perform an important function in that they locate the garment at the proper position on the wearer in order to provide a neat fit and appearance.

The manner in which a wearer puts on the garment 5 will be apparent. First the neck strap 11 is put over the head or around the neck and then the left-hand sash 8 is brought around from behind the wearer's body and pulled through the slot opening 24. The sash 10 and the left-hand section of the skirt are then brought around and wrapped over the right-hand skirt section 17 and the sashes 8 and 10 are then looped or tied.

I claim:

1. A wrap-around jumper dress comprising a separate wrap-around skirt and a separate bib with the lower edge of said bib being joined to the front central portion of the upper edge of said skirt, said lower edge of said bib and said front central portion of the upper edge of said skirt each being concave when laid out flat prior to being joined together.

2. The dress called for in claim 1 wherein said separate wrap-around skirt is formed of said front central portion and separate left and right-hand portions joined thereto with each of said left and right hand portions having concave upper edges forming belt-like continuations of said upper edge of said front central portion.

3. The dress called for in claim 1 wherein a sash is attached to the opposite upper corners of said skirt and an opening is provided adjacent one of the upper corners of said front central portion for receiving therethrough the sash attached to the more remote of said opposite upper corners.

4. The dress called for in claim 3 wherein said sashes are flat and generally uniform in width and said opening is in the form of a generally vertical slot having a length approximately equal to the width of said sashes.

5. The dress called for in claim 1 wherein said bib has inner and outer thicknesses with the outer thickness having said concave edge which is joined by a seam to said concave edge of said front central skirt portion, and said inner thickness of said bib extending down over said seam to shield the same.

* * * * *